US005158234A

United States Patent [19]

Magnenat et al.

[11] Patent Number: 5,158,234

[45] Date of Patent: Oct. 27, 1992

[54] SANITARY SHOWER WITH MANIPULABLE HEAD AND SELECTIVE OUTFLOWS

[75] Inventors: Alain Magnenat, Annemasse; Daniel Meylan, Versoix; Jean-Jacques Rodriguez, Douvaine, all of France

[73] Assignee: Kugler, Fonderie et Robinetterie S.A., Geneva, Switzerland

[21] Appl. No.: 642,215

[22] Filed: Jan. 16, 1991

[30] Foreign Application Priority Data

Jan. 26, 1990 [CH] Switzerland ..... 262/90

[51] Int. Cl.[5] ..... B05B 1/16

[52] U.S. Cl. ..... 239/449; 239/447; 239/582.1; 239/588; 4/678

[58] Field of Search ..... 239/195, 443, 444, 445, 239/446, 447, 448, 449, 588, 582.1; 4/192, 567, 615, 675–678; 137/801

[56] References Cited

U.S. PATENT DOCUMENTS

| | | | |
|---|---|---|---|
| 603,144 | 4/1898 | Kellerman et al. | 239/444 X |
| 2,416,737 | 3/1947 | Budan | 239/447 |
| 3,144,878 | 8/1964 | Williams | 239/444 X |
| 4,827,538 | 5/1989 | Heimann et al. | 4/192 |
| 5,009,247 | 4/1991 | Oberdörfer | 137/801 X |
| 5,056,562 | 10/1991 | Pawelzik et al. | 239/588 X |

FOREIGN PATENT DOCUMENTS

| | | | |
|---|---|---|---|
| 3022706 | 12/1981 | Fed. Rep. of Germany | 4/615 |
| 3135860 | 3/1983 | Fed. Rep. of Germany | 4/615 |
| 3339849 | 5/1985 | Fed. Rep. of Germany | 4/615 |
| 3509649 | 9/1986 | Fed. Rep. of Germany | 4/615 |
| 87162393 | 3/1988 | Fed. Rep. of Germany . | |
| 3637470 | 5/1988 | Fed. Rep. of Germany | 239/447 |
| 3700927 | 7/1988 | Fed. Rep. of Germany | 239/443 |
| 935079 | 8/1963 | United Kingdom . | |
| 2048721 | 12/1980 | United Kingdom | 239/447 |
| 2050157 | 1/1981 | United Kingdom . | |
| 2219497 | 12/1989 | United Kingdom . | |

*Primary Examiner*—Andres Kashnikow
*Assistant Examiner*—William Grant
*Attorney, Agent, or Firm*—Young & Thompson

[57] ABSTRACT

A sanitary shower comprises a handle removably securable to the shower body, a head removably securable to the handle, and a flexible conduit for water supply that passes through the shower body and the handle and is secured to the head. The handle is elongated and has a longitudinal slot therethrough, of a width sufficient to receive the flexible conduit when the head is separated from the handle but the handle remains on the shower body. The head has an inlet and two outlets each communicating with a chamber within the head for dispensing water through the two outlets in two directions, and an obturating member in the head comprising a flap that swings about an axis perpendicular to those two directions and in one position closes one outlet and leaves the other outlet open, and in another position leaves the one outlet open and closes the other outlet against the flow of water from the inlet.

4 Claims, 4 Drawing Sheets

SANITARY SHOWER WITH MANIPULABLE HEAD AND SELECTIVE OUTFLOWS

FIELD OF THE INVENTION

The invention relates to an outflow device for sanitary shower comprising at least a head which can be fixed on an appropriate part of the sanitary shower, this device being connected through a flexible conduit to a water supply. The head is fixed in a removable way through fitting on the said part of the shower and the said flexible conduit is fixed to the said head for its supply with water.

Furthermore, this shower comprises two outlets communicating each with a chamber located inside the head. These two chambers are connected through a channel. It comprises further an obturating member which is displacable between a position in which it closes the linkage connecting the first chamber to the first outlet opening and a second position in which it closes the passage connecting the two chambers.

More and more, the taps for sinks, particularly for kitchen sinks, are equipped with extensible small showers instead of rotatable small spouts only. In fact to be able to separate the shower from the body of the tab by a certain distance enables a greater manipulability and an increased ease of the cleaning of the sink and of the working surface or of the adjacent draining surface. Such showers can also be used for baths and shower stalls.

THE KNOWN PRIOR ART

There one knows from document DE 3.637.740 an outflow device for a sanitary shower which comprises a head provided with two concentric water outlets, the one provided with an aerator and the other one with a shower. This head houses an obturating mechanism of the one or the other of these outlets at the choice of the user. A spring biases this mechanism back into a predetermined rest position, shower or aerator, when the outflow pressure diminishes below a certain pre-established threshold.

The control of this obturating mechanism is effected manually by pushing on pushmembers through a flexible portion of the wall of the head of the device. This is an inconvenience, this flexible portion of the wall of the head being fragile.

Furthermore, the automatic return into rest position of the control mechanism is also a drawback since it is impossible below a given water pressure and thus a given flow, to choose the outflow mode.

There is also known from DE-G 87.16.2393 a sanitary shower having only one hole provided with a small shower connected through a flexible conduit. The handle of this shower fits into the body of the shower of which body the part receiving the handle can be slotted to give passage to the flexible conduit.

OBJECTS OF THE INVENTION

The present invention has particularly for its aim the realization of an outflow device for a sanitary shower comprising two water outlets of different nature, shower or aerator, which remedies to the precited drawbacks.

Furthermore, the outlet of the present invention has to permit a greater mobility of the outflow head while maintaining a small size of it in order to facilitate its use as well as a bath shower as a kitchen shower. Finally, a last aim of the present invention is to simplify the control and selection mechanism of one of the water outlets to reduce the manufacturing cost of the device.

BRIEF SUMMARY OF THE INVENTION

The objects of the invention are achieved by providing a sanitary shower which comprises a handle removably securable to the shower body, a head removably securable to the handle, and a flexible conduit for water supply that passes through the shower body and the handle and is secured to the head. The handle is elongated and has a longitudinal slot therethrough, of a width sufficient to receive the flexible conduit when the head is separated from the handle but the handle remains on the shower body. The head has an inlet and two outlets each communicating with a chamber within the head for dispensing water through the two outlets in two directions, and an obturating member in the head comprising a flap that swings about an axis perpendicular to those two directions and in one position closes one outlet and leaves the other outlet open, and in another position leaves the one outlet open and closes the other outlet against the flow of water from the inlet.

The attached drawings show schematically and by way of example one embodiment and a variant of the shower according to the invention.

Figure 1:
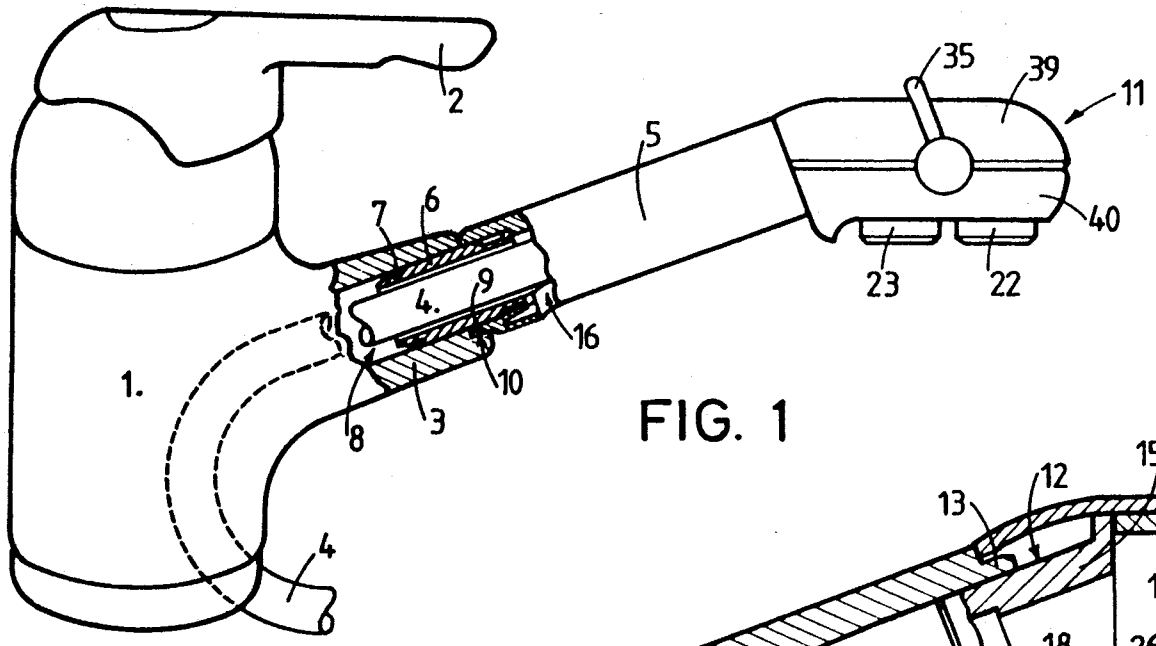
FIG. 1 is a general view of a shower according to the invention, seen from the side, showing the outflow head connected to its feeding flexible conduit, and a handle fitting into the body of the sanitary shower.

The embodiment of the sanitary shower according to the invention which is shown in the drawings by way of example is a kitchen shower mounted on a one hole mixer.

As seen in FIG. 1, in such an embodiment, the body 1 of the mixer housing the mechanism which is actuated by the sole control lever 2 comprises a spout 3 of short length in which the flexible conduit 4 of the small shower slides and the open end of which is adapted to receive through fitting the handle 5 of the shower.

For that, the upstream end of the handle 5 is provided with a metallic part 6 presenting a gasket 7, which part 6 fits into the central cavity 8 of the spout 3. Furthermore, to determined the rest angular position or the working angular position of the shower, that is to say with the water outlets directed downwards, as will be seen later on, the upstream end of the handle 5 presents a lug 9 cooperating with the housing 10 in the end of the spout 3. Therefore, once it is fitted fully into this part 3, the handle 5 is fixed to it in a determinated angular position.

This fixing or assembling mode of a shower on the body of a mixer having only one hole, is otherwise conventional and largely used nowadays.

However what is original and new in the present shower, is that the head or rose 11 of the shower rigidly connected to the water feeding flexible conduit 4, is mounted in a removable way on the downstream end of the handle 5. The rose 11 and the downstream end of the handle 5 comprise also corresponding formations 12, 13 permitting angularly positioning the head 11 with respect to handle 5. This head is also provided with a part 14 similar or even identical to the part 6 of the handle 5 which can be fitted either into the downstream end of the handle 5 or into the end of the spout 3. The downstream end of the flexible conduit 4, passing through the part 14 is fixed to the body 15 of the head 11.

Thanks to this disposition, the user can take in his hand either the whole of the shower, handle 5 and rose 11, or only the rose 11 which is less cumbersome for rinsing small utensils.

Furthermore, the handle comprises a longitudinal slot 16 extending from the downstream end of the handle 5 along at least a part, generally about 70% to 90% of its length. This slot 16 is sufficiently wide to give passage to the flexible conduit 4 so that when the user takes in hand the rose 11 only, he may easily rinse the immediate surroundings of the the body 1 of the mixer, which is not the case if he must take as usually the whole shower.

The body 15 of the head 11 comprises further a lug 17 corresponding to the lug 9 of the handle 5 which can cooperate with the end of the spout 3 and its housing 10 in case rose 11 is directly mounted on the mixer without the handle 5 when it is necessary for example to equip sinks or containers of small dimensions. In a variant, the handle 5 could be slotted over its whole length in order to be removable without necessitating the dismantling of the flexible conduit 4.

The head 11 or rose of the shower comprises a body 15 the upstream end of which is provided with the part 14, and comprises fixing means, generally a threading, for the flexible conduit 4. This upstream end comprises a water entry chanel 18, opening into a first chamber 19. This first chamber 19 is connected by means of a passage 20 to a second chamber 21, also located in the body 15 of the head 11.

The lower face of the body 15 of the head 11 comprises two outlets openings 24, 25, preferably having the same diameter, provided with a threading permitting fixing an aerator 22 or a shower head 23 therein. When the threadings of the outlet openings are identical, the aerator and the shower head are thus interchangeable.

The body 15 comprises further a wall 26 separating the outlet aperture 25 of the first chamber 19, wall 26 being with an opening 27 of a diameter approximately equal to that of the passage 20 connecting the chambers 19 and 21.

Figure 2:
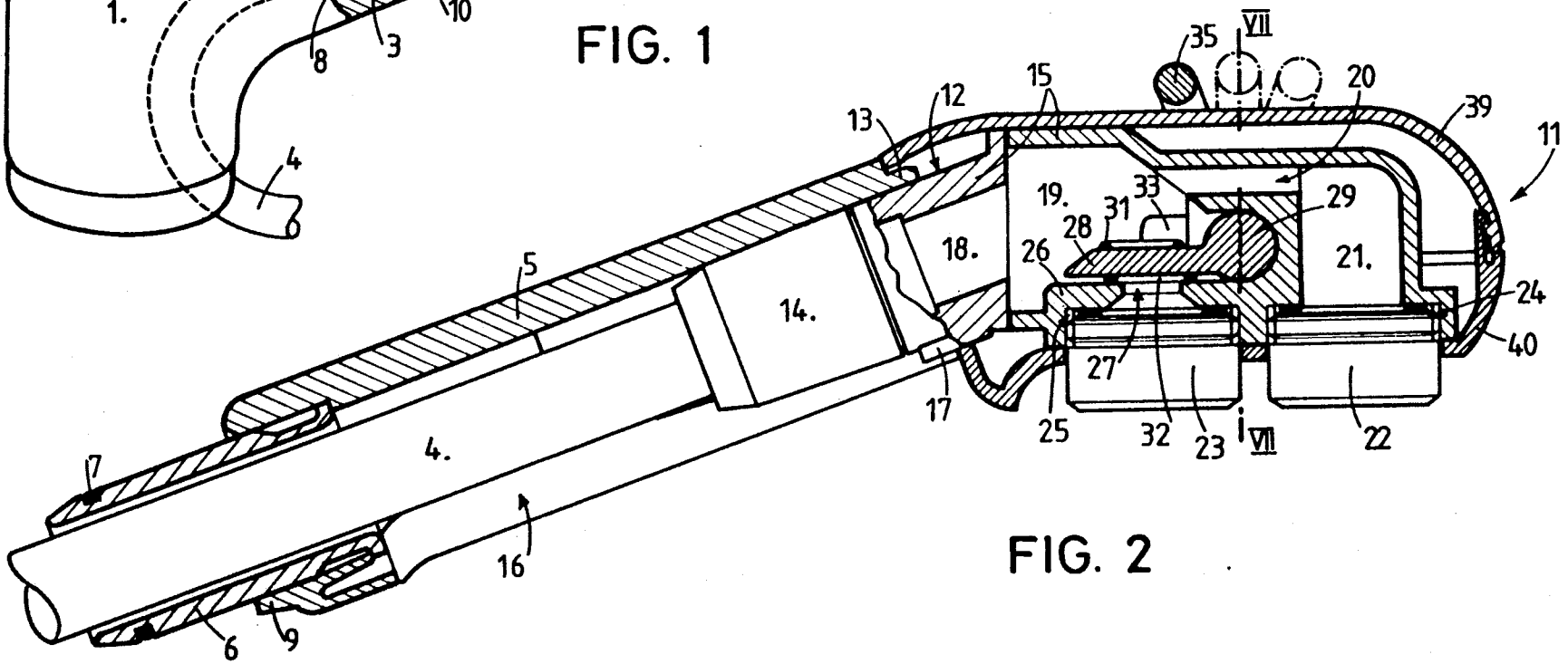
FIG. 2 is a view in crossection of the handle and of the head of the outflow device showing particularly the control mechanism of the water outlets.
Figure 3:
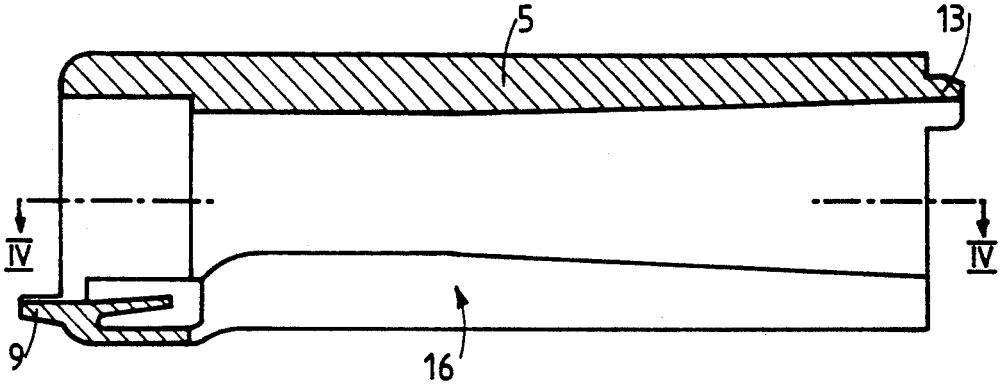
FIG. 3 is a view in crossection of the handle according to line III—III of FIG. 4.
Figure 4:
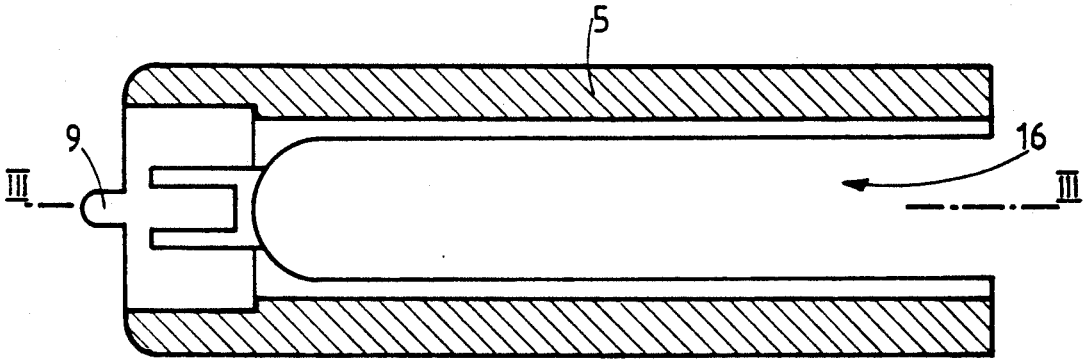
FIG. 4 is a view in crossection of the handle according to line IV—IV of FIG. 3.
Figure 5:
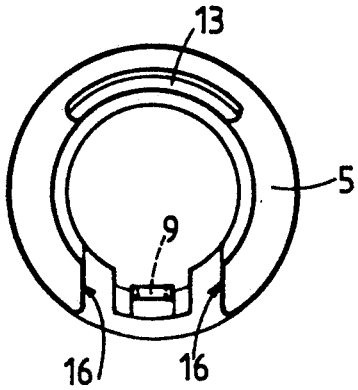
FIG. 5 is a view of the downstream end of the handle.
Figure 6:
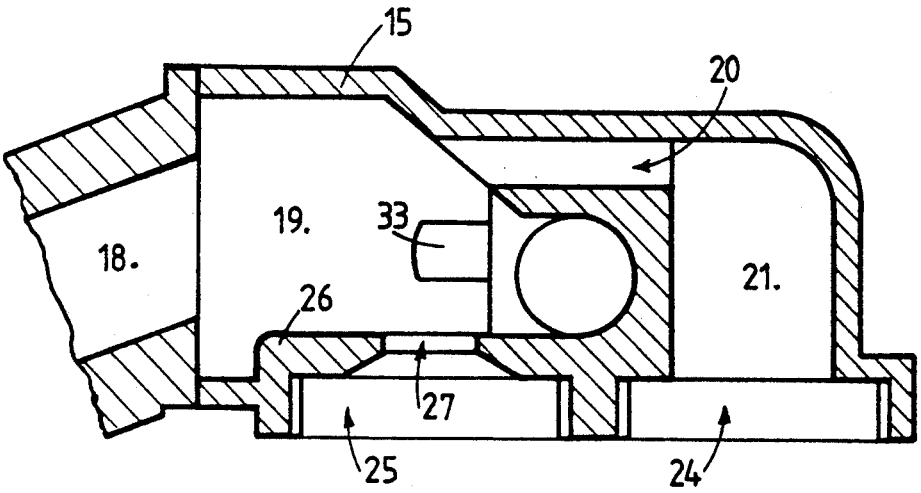
FIG. 6 is a crossection of the body of the head without mechanism nor housing.
Figure 7:
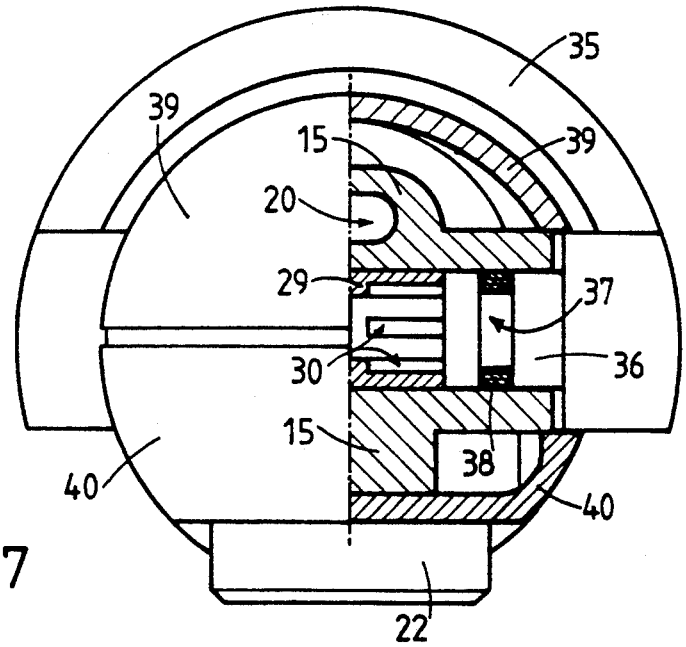
FIG. 7 is a partial crossection along line VII—VII of FIG. 2.
Figure 8:
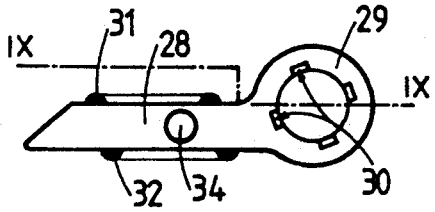
FIG. 8 is a view from the side of the obturating mechanism.
Figure 9:
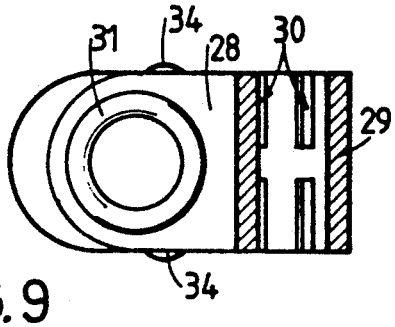
FIG. 9 is a view partially in crossection along line IX—IX of FIG. 8 of the obturator of the mechanism.

An obturation member, here a flap 28, is pivotally mounted in the body 15 by means of a shaft 29, of one-piece construction with the flap and provided with oppositely axially outwardly opening cylindrical blind recesses having on their inner surfaces parallel grooves; 30. Each of the faces of the flap 28 bears a gasket 31, 32. In a first position of the flap shown in FIG. 2, the gasket 32 surrounds the opening 27 and effects a tight closure between the first chamber 19 and the outlet aperture 25. In this first position of the flap 28 the passage 20 is free and water flows from the first chamber 19 into the second chamber through the passage 20 to come out through the aperture 24.

In a second position of the flap 28, the gasket 31 surrounds the upstream end of the passage 20 and obturates it in a tight manner so that the water flows out of the first chamber 19 through the outlet aperture 25 directly. It is to be noted that these two angular positions of the flap 28 are both stable so that even if the water pressure diminishes, the flap does not change automatically its position. Furthermore, these two different angular positions of the flap 28 are mechanically determined. Thus, the body 15 presents resiliently deformable blades 33 cooperating with studs 34 positioned on the edge of the flap 28 constituting together an assembly permitting maintaining the flap 28 in each of its angular positions.

The head comprises further an actuating member 35 presenting the shape of a stirrup the arms of which are fast with shafts 36 the ribbed ends of which fit into the openings with grooves 30 of the shaft 29 of the flap for its actuation. These shafts 36 are provided with a groove 37 housing a gasket 38 and ensuring the tightness with the bore of the body 15.

Finally the head 11 comprises further two shells or shapes 39, 40 surrounding the body 15 and adapted to be secured to each other; by clipping or fitting the one into the other.

The manufacture and the assembly of this head are very simple and thus decrease the manufacturing cost. The shape of the head is defined by the shells and can be adapted to the fancy shapes of the moment without modifying the body 15 or the mechanism. Finally, the mechanism, that is the flap 28, is particularly simple, and does not comprise any element which can age such as a spring or the like.

Finally, on the contrary of the existing showers which have all the inconvenience of having a mechanism coming automatically back into the aerator position when the water pressure diminishes, the mechanism of the present shower remains in the position chosen by the user, who can thus use the shower even at low pressure, avoiding thus any splashing.

Finally, as seen above, one of the main advantages of this shower resides in the fact that the user can take in his hand the head 11 only and that he has thus a very great manipulability thanks to the slot 16 of the handle which gives passage to the flexible conduit 4.

Figure 10:
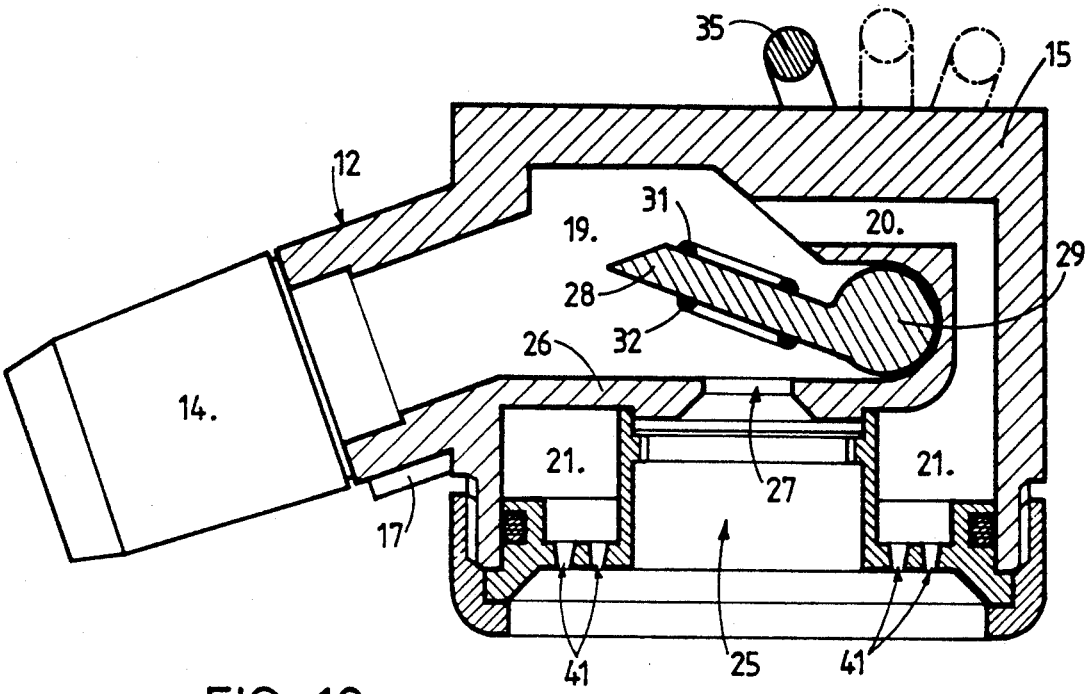
FIGS. 10 and 11 show, in crossection and from underneath, a variant of the device in which the water outlets are coaxial.
Figure 11:
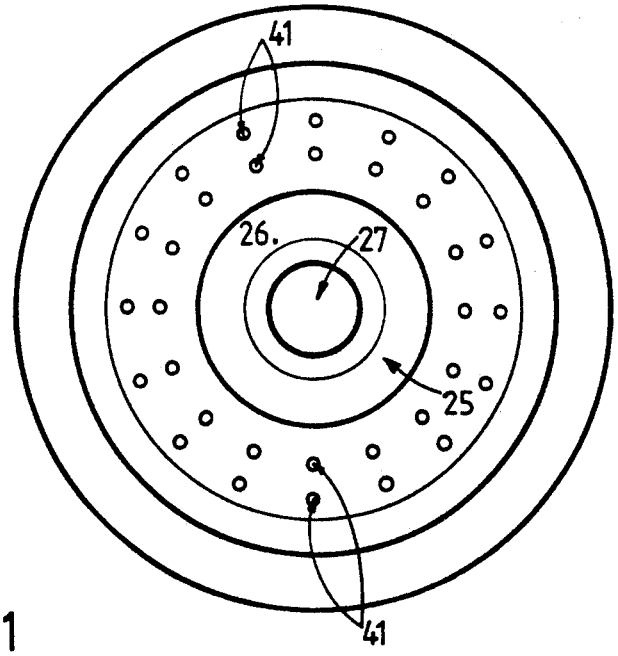

In the variant shown in FIGS. 10 and 11, the passage 20 connects the first chamber 19 to a second chamber 21 which is annular and concentric to the first outlet opening 27. This annular chamber 21 feeds a plurality of channels 41 coming out around the aerator (not shown) fed by the outlet opening 27. One obtains thus a head of a shower which is very compact, having concentric outlets, and presenting all the advantages of formerly described embodiment.

In variants, it is evident that the actuating member 35 permitting the tilting of the flap could be realized differently. This actuating member can have the shape of a button or of a handle located on only one side of the head.

As seen from the preceeding, the shower according to the invention comprises an assembly constituted by a handle and a head. Each of these elements, handle and head, presents original and advantageous characteristics, which cooperate for the obtention of an assembly comprising, a shower which can be easily manufactured and at low cost, and presenting exceptional qualities of use.

The originality of the handle resides in its longitudinal slot whereas the originality of the head resides in the design of its mechanism which is simple and presents two stable positions.

We claim:

1. A sanitary shower comprising a shower body, a handle removably securable to the shower body, a head removably securable to the handle, a flexible conduit for water supply that passes through the shower body and the handle and is secured to the head, the handle being elongated and having a longitudinal slot therethrough, said slot being of a width sufficient to receive the flexible conduit when the head is separated from the handle but the handle remains on the shower.

2. A sanitary shower as claimed in claim 1, said shower body and handle having complementary parts thereon that predetermine an angular position of the handle relative to the body, said handle and head having complementary parts thereon that predetermine an angular position of the head relative to the handle, said head being removably securable to said shower body when said handle is removed and said complementary parts of said shower body and head determining a predetermined angular position of said head relative to said shower body when said head is secured to said shower body.

3. A sanitary shower as claimed in claim 1, in which said slot extends most of the length of the handle and has an open end and a closed end.

4. A sanitary shower as claimed in claim 1, in which said slot extends the full length of the handle and has two open ends.

* * * * *